United States Patent [19]

Heider et al.

[11] Patent Number: 4,548,399

[45] Date of Patent: Oct. 22, 1985

[54] APPARATUS FOR ALIGNING SHEETS IN A STACK

[75] Inventors: Alfred Heider, Munich; Erich Schlick, Lohof; Günther Schnall, Eching, all of Fed. Rep. of Germany

[73] Assignee: AGFA-Gevaert Aktiengesellschaft, Leverkusen, Fed. Rep. of Germany

[21] Appl. No.: 531,594

[22] Filed: Sep. 12, 1983

[30] Foreign Application Priority Data

Sep. 11, 1982 [DE] Fed. Rep. of Germany ..... 3233811

[51] Int. Cl.[4] ..... B65H 31/38

[52] U.S. Cl. ..... 271/221; 414/28

[58] Field of Search ..... 271/221, 220, 222, 223, 271/224, 226, 233, 234, 238, 240, 248, 250; 414/28, 36, 46

[56] References Cited

U.S. PATENT DOCUMENTS

| | | | |
|---|---|---|---|
| 1,421,868 | 7/1922 | Volkmere | 271/221 |
| 2,027,341 | 1/1936 | Hornbeck et al. | 271/221 |
| 2,275,688 | 3/1942 | Schulz | 271/222 |
| 3,604,343 | 9/1971 | Thornfelt | 414/36 X |

*Primary Examiner*—Bruce H. Stoner, Jr.

*Assistant Examiner*—Lawrence J. Goffney, Jr.

*Attorney, Agent, or Firm*—Michael J. Striker

[57] ABSTRACT

An apparatus for aligning and squaring a stack of sheets has a support plate having a generally horizontal and flat support surface adapted to support the stack of sheets, a guide projecting upward from the support surface and having an abutment face directed in a predetermined direction generally parallel thereto, and a generally horizontal rod vertically spaced from the surface and stack and extending in the direction. A pusher element carried on the rod is slidable thereon in the direction, friction alone linking the element and rod together in the direction. This pusher element is engageable with a sheet on the surface. A stop facing opposite to the direction is also engageable with the element. A drive reciprocates the rod in the direction through a predetermined stroke toward and away from the guide. Thus on displacement toward the guide the element engages and pushes a sheet opposite the direction until the sheet engages thereagainst, at which time the element slides on the rod. On opposite displacement the element engages the stop and is displaced relative to the rod in the direction to its starting position on the rod.

11 Claims, 4 Drawing Figures

APPARATUS FOR ALIGNING SHEETS IN A STACK

FIELD OF THE INVENTION

The present invention relates to an apparatus for aligning sheets in a stack. More particularly this invention concerns an apparatus used in a copier or a copy sorter and stapler for squaring up the stacks of copies.

BACKGROUND OF THE INVENTION

It is necessary in many copying and sorting machines, such as described in commonly owned allowed patent application Ser. No. 533,578 filed Sept. 19, 1983 now U.S. Pat. No. 4,497,478, of R. Reschenhofer et al, to provide a mechanism for squaring up, that is aligning one atop the other, the sheets that are fed in either one at a time or in groups. When the sheets are to be stapled or bound by an automatic device, it is absolutely essential that they be in proper alignment.

A standard such device is German Pat. No. 649,028. It has a support plate on whose surface the sheets are deposited. Several pins are fixed along one edge of the plate, and several movable pins carried on arms or rods underneath the plate project up through slots in this plate. A mechanism is provided to move these latter pins toward the stationary ones to push the sheets thereagainst and thereby align and square them up.

The main problem with such a device is that the stroke of the movable pins must be very carefully adjusted. If it is too short the sheets will not be properly aligned; if it is too long the edges of the sheets will be crumpled. In addition if a sheet gets slightly jammed, it will be damaged, necessitating manual correction.

OBJECTS OF THE INVENTION

It is therefore an object of the present invention to provide an improved apparatus for aligning sheets.

Another object is the provision of such an apparatus for aligning sheets which overcomes the above-given disadvantages, that is which does not need to be readjusted whenever sheet size changes, and that will normally not damage even a malpositioned sheet.

SUMMARY OF THE INVENTION

An apparatus for aligning and squaring a stack of sheets according to the invention has a support plate having a generally horizontal and flat support surface adapted to support the stack of sheets, a guide projecting upward from the support surface and having an abutment face directed in a predetermined direction generally parallel thereto, and a generally horizontal rod vertically spaced from the surface and stack and extending in the direction. A pusher element carried on the rod is slidable thereon in the direction, friction alone linking the element and rod together in the direction. This pusher element is engageable with a sheet on the surface. A stop facing opposite to the direction is also engageable with the element. A drive reciprocates the rod in the direction through a predetermined stroke toward and away from the guide. Thus on displacement toward the guide the element engages and pushes a sheet opposite the direction until the sheet engages thereagainst, at which time the element slides on the rod. On opposite displacement the element engages the stop and is displaced relative to the rod in the direction.

According to another feature of this invention the drive means reciprocates the element through a stroke at least equal to the difference in size between the largest sheet and smallest sheet to be aligned by the apparatus. Thus the apparatus need not be readjusted when sheet size changes, and when a sheet is misaligned, the apparatus of this invention can continue to function without crumpling its edge, normally aligning it during a later operating cycle. Since the force exerted on the sheet is purely determined by the speed and inertia of the pusher element and by the friction between this element and the rod, it is possible to use just enough force to do the aligning job, without running any risk of damaging a sheet.

The element of this invention can be a disk centered on and rotatable about the rod, and a hub fitted on the rod and of a length measured in the direction greater than the diameter of the rod. Thus sufficient friction can be created to align even a heavy sheet, and the long hub can prevent the disk from canting on the rod.

Although only a single such element need be provided, which is normally only done when the plate is inclined considerably for automatic alignment against a second such guide provided on the plate facing generally perpendicular to the first mentioned guide. It is also possible to provide a second such rod extends in a second direction generally perpendicular to the first-mentioned direction and a second such element is provided on the second rod. The drive means is connected to both of the rods to displace same in the respective directions. This drive means includes a drive shaft rotating about an axis generally perpendicular to both of the directions, respective first and second generally perpendicular cranks carried on and extending radially from the shaft, and respective first and second rigid links connected between the cranks and the rods for transmitting force therebetween. The first and second cranks are of different lengths that correspond generally to the variations in the respective dimensions of the sheets. With this type of drive perfectly synchronous operation of the two pushers is ensured, so that once a sheet's static friction is overcome it can easily be moved into position. It is also possible to gang several such elements along one edge of the sheets, a feature used when sheets of very large format are being worked with.

The element according to this invention can also be a tab extending upward from the rod through the plate and having a center of gravity below the rod. This tab is not centered on the rod, but is rotatable thereon to compensate for transverse shifting of the sheet it is pushing, and is provided below the rod with a weight to return it to an upright position if it is tipped.

DESCRIPTION OF THE DRAWING

The above and other features and advantages will become more readily apparent from the following, reference being made to the accompanying drawing in which.

SPECIFIC DESCRIPTION

Figure 1:
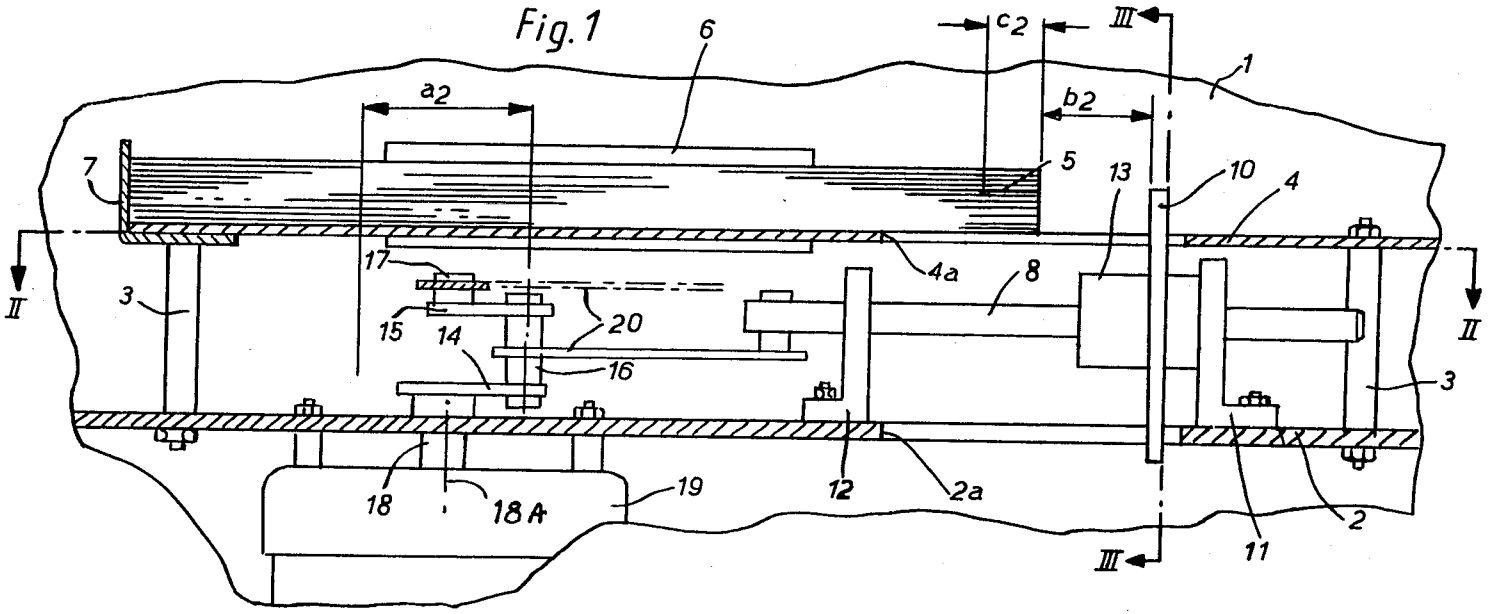
FIG. 1 is a vertical and longitudinal section through the apparatus of this invention.
Figure 4:
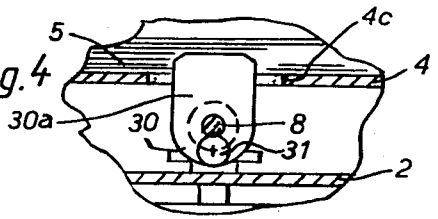
FIG. 4 is a view like FIG. 3 but showing a variant on the system of this invention.
Figure 3:
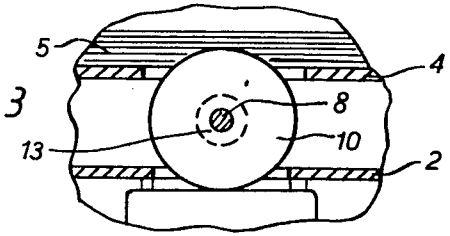
FIG. 3 is a section taken along line III—III of FIG. 1 but in smaller scale.
Figure 2:
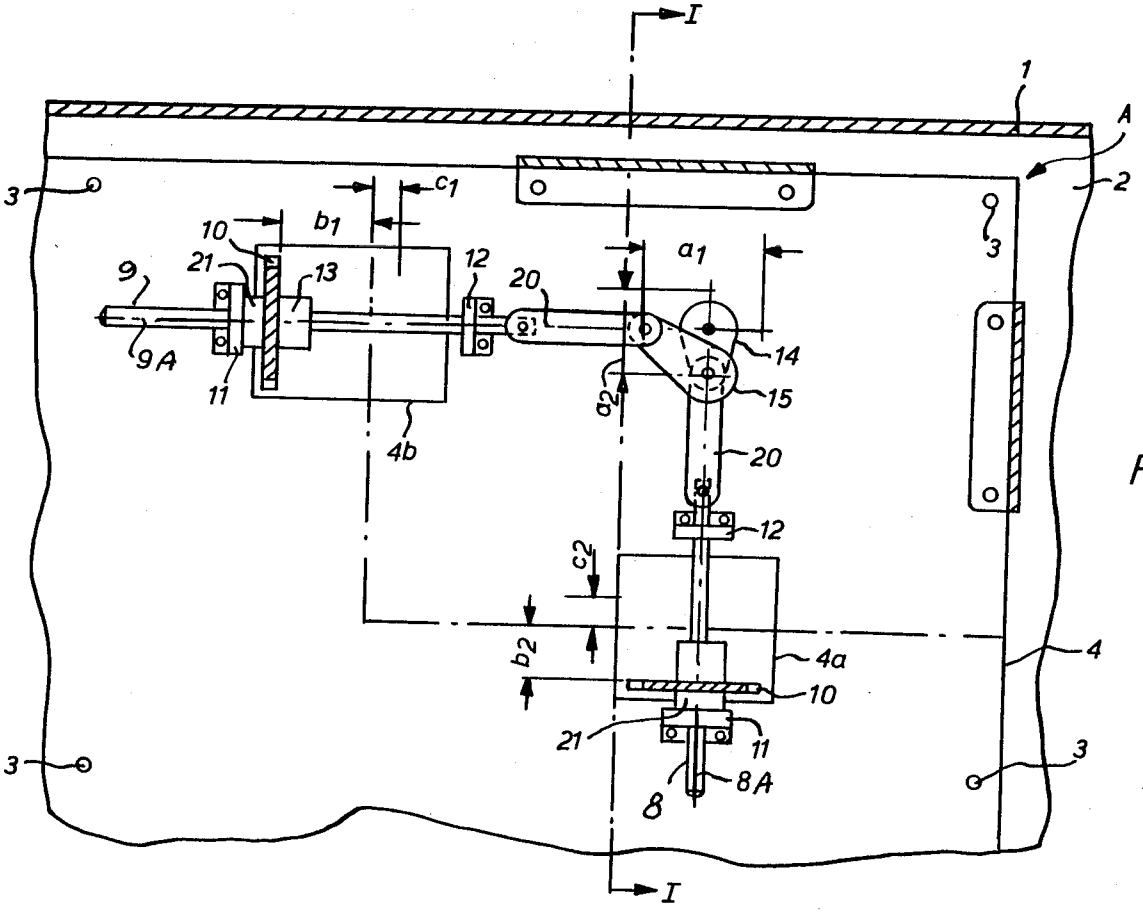
FIG. 2 is a section taken along line II—II of FIG. 1, in enlarged scale, line I—I indicating the section plane of FIG. 1.

As seen in FIGS. 1, 2, and 3, the apparatus for aligning or squaring up a stack 5 of sheets according to this invention has a housing 1 provided with a base plate 2 on which a sheet-support plate 4 is supported by posts 3. This plate 4 has an at least generally horizontal and planar upper surface and is provided with two edge guides or abutments 6, 7 extending along adjacent edges thereof at 90° to each other. The plate 4 may be inclined somewhat toward the edge guides 6 and/or 7 so that gravity can assist aligning the sheet stack 5 therewith.

Underneath the plate and parallel to the guides 6 and 7 are two rods 8 and 9 supported in respective identical outer and inner pillow blocks 11 and 12 so that these rods 8 and 9 can slide along the respective axes 8A and 9A relative thereto. These rods 8 and 9 carry respective identical circular disks 10 centered on and perpendicular to the respective axes 8A and 9A and extending through respective holes **4*a* and 4*b* in the plate 4 and other such holes 2*a* in the plate 2. These disks 10 are each fixed to a respective hub 13 having a central bore that is slightly larger than the outer diameter of the respective rod 8 or 9, and are not fixed to the rods 8 and 9. Thus, when as described below the rods 8 and 9 are reciprocated axially, the disks 10 will be entrained axially purely and exclusively by frictional engagement of the hubs 13 on the rods 8 and 9**.

The hubs 13 have an axial length substantially greater than the diameters of their bores to prevent canting of the disks 10 on the rods 8 and 9 and to maximize frictional contact between the hubs 13 and the rods 8 and 9. In addition each of the outer pillow blocks 11 is provided with a roller-type bumper 21 that is engageable with the outer face of the respective disk 10.

A drive for reciprocating the disks 10 has a motor 19 whose output shaft 18 is centered on an axis 18A perpendicular to the plane of the axes 8A and 9A and lying at the intersection thereof. This shaft 18A carries a radially extending crank 14 and 15. The outer end of the crank 14 carries a pivot 16 on which is mounted the inner end of a rigid link 20 whose outer end is pivoted on the end of the rod 8. The other crank 15 similarly has at its outer end a pivot 17 on which is pivoted another such link 20 connected to the inner end of the shaft 9.

The relative lengths of the cranks 14 and 15 between the axis 18A and the respective outer pivots 16 and 17 are different, with the crank 15 longer than the crank 14. These two lengths normally form a ratio equal to the standard width-to-length ratio for a standard page, typically equal to 8.5:11, which ratio is generally equal to the normal variation in size in the respective directions on the sheet.

Thus as seen in FIG. 2 the pivot 17 and the rod 9 are moved through an axial stroke $a_1$ and the pivot 16 and rod 8 through a shorter stroke $a_2$. These strokes $a_1$ and $a_2$ exceed by respective extents $c_1$ and $c_2$ the differences $b_1$ and $b_2$ in sheet size normally encountered.

In use copies are dropped onto the top surface of the plate 4 generally against the guides 6 and 7. The motor 19 rotates the cranks 14 and 15 to reciprocate the shafts 8 and 9, axially frictionally entraining the disks 10. When the inner face of each disk 10 strikes the respective edge of the copy, its inertia plus the force transmitted frictionally between the shaft 8 or 9 and the respective hub will be enough to push the opposite edge of copy against the respective guide 6 or 7. Rotation of the disks 10 about the axes 8A and 9A permits simultaneous displacement in two orthogonal directions.

Once the opposite edge of each copy engages the respective guide 6 or 7, the copy will stop and the respective disk 10 will slide on the rod 8 or 9, moving axially outward, that is away from the axis 18A, thereon. Thereafter, when the rod reverses, the disks 10 will engage outward against the bumpers or stops 21 and will be pushed back to their normal starting positions, so that the operation can take place again on the next sheet copy. Since these disks 10 are driven by a crank, their speeds will increase and decrease sinusoidally, thereby minimizing inertial slippage on the rods 8 and 9 when they change direction.

Such an arrangement will therefore simply and accurately square up and align the copies of the stack. This action will be effective whether the stack 5 is formed of individual sheet copies, or of stapled together pamphlets or bundles.

We claim:

1. An apparatus for aligning and squaring a stack of sheets, the apparatus comprising:

a support plate having a generally horizontal and flat support surface adapted to support the stack of sheets;

a guide projecting upward from the support surface and having an abutment face directed in a predetermined direction generally parallel thereto;

a generally horizontal rod vertically spaced from the surface and stack and extending in the direction;

a pusher element carried on the rod and slidable thereon in the direction, friction alone linking the element and rod together in the direction, the pusher element being engageable with a sheet on the surface;

a stop facing opposite to the direction and engageable with the element; and drive means for reciprocating the rod in the direction through a predetermined stroke toward and away from the guide, whereby on displacement toward the guide the element engages and pushes a sheet opposite the direction until the sheet engages thereagainst, at which time the element slides on the rod and on opposite displacement the element engages the stop and is displaced relative to the rod in the direction.

2. The aligning apparatus defined in claim 1 wherein the drive means reciprocates the element through a stroke at least equal to the difference in size between the largest sheet and smallest sheet to be aligned by the apparatus.

3. The aligning apparatus defined in claim 1 wherein the element includes a disk centered on and rotatable about the rod.

4. The aligning apparatus defined in claim 3 wherein the element includes a hub fitted on the rod and of a length measured in the direction greater than the diameter of the rod.

5. The aligning apparatus defined in claim 1, further comprising:

a second such guide on the plate facing generally perpendicular to the first mentioned guide;

a second such rod extending in a second direction generally perpendicular to the first-mentioned direction;

a second such element on the second rod, the drive means being connected to both of the rods to displace same in the respective directions.

6. The aligning apparatus defined in claim 5 wherein the drive means includes a drive shaft rotating about an axis generally perpendicular to both of the directions;

respective first and second cranks carried on and extending radially from the shaft; and respective first and second rigid links connected between the cranks and the rods for transmitting force therebetween.

7. The aligning apparatus defined in claim 6 wherein the first and second cranks are of different lengths that correspond generally to the variations in the respective dimensions of the sheets.

8. The aligning apparatus defined in claim 1 wherein the element is a tab extending upward from the rod through the plate and having a center of gravity below the rod.

9. The aligning apparatus defined in claim 8 wherein the tab is not centered on the rod.

10. The aligning apparatus defined in claim 9 wherein the tab is rotatable about the rod and is provided therebelow with a weight.

11. The aligning apparatus defined in claim 1 wherein the guide is straight and perpendicular to the direction.

* * * * *